US006295766B1

(12) United States Patent
Bigelow

(10) Patent No.: US 6,295,766 B1
(45) Date of Patent: Oct. 2, 2001

(54) BUILDING CONSTRUCTION

(76) Inventor: William H. Bigelow, P.O. Box 7064, Houston, TX (US) 77248

( * ) Notice: Subject to any disclaimer, the term of this patent is extended or adjusted under 35 U.S.C. 154(b) by 0 days.

(21) Appl. No.: 09/276,895

(22) Filed: Mar. 25, 1999

(51) Int. Cl.[7] ..... E04B 7/02

(52) U.S. Cl. ..... 52/79.1; 52/79.5; 52/91.1; 52/634; 52/143; 52/90.1

(58) Field of Search ..... 52/79.5, 236.3, 52/236.7, 93.2, 143, 90.1, 91.1, 634, 638, 79.1

(56) References Cited

U.S. PATENT DOCUMENTS

| | | | | |
|---|---|---|---|---|
| 259,493 | * | 6/1882 | Church . | |
| 597,916 | * | 1/1898 | Rowell . | |
| 758,033 | * | 4/1904 | Holmes . | |
| 1,899,391 | * | 2/1933 | Kass . | |
| 1,900,833 | * | 3/1933 | Maul . | |
| 2,012,798 | * | 8/1935 | Whittier . | |
| 2,181,200 | * | 11/1939 | Papineau . | |
| 2,633,610 | | 4/1953 | Hervey . | |
| 3,241,273 | * | 3/1966 | Struben . | |
| 3,378,971 | * | 4/1968 | Singer et al. | 52/236.7 |
| 3,410,041 | * | 11/1968 | Bolt et al. | 52/79.5 |
| 3,429,092 | * | 2/1969 | Perry et al. | 52/236.7 |
| 3,707,811 | * | 1/1973 | Hampson | 52/143 |
| 3,747,290 | * | 7/1973 | Barrell et al. . | |
| 3,832,811 | * | 9/1974 | Briel, Jr. | 52/143 |
| 3,932,976 | * | 1/1976 | Steel | 52/309.9 |
| 4,122,639 | * | 10/1978 | Barrell . | |
| 4,274,234 | * | 6/1981 | Abell . | |
| 4,327,529 | | 5/1982 | Bigelow, Jr. et al. . | |
| 4,364,206 | | 12/1982 | Wybauw . | |
| 4,470,227 | | 9/1984 | Bigelow, Jr. et al. . | |
| 4,574,533 | | 3/1986 | Bigelow, Jr. et al. . | |
| 4,637,179 | | 1/1987 | Bigelow, Jr. et al. . | |
| 4,833,841 | * | 5/1989 | Ellington, III | 52/143 |
| 4,901,484 | * | 2/1990 | Santosuosso . | |
| 4,942,712 | * | 7/1990 | Thompson . | |
| 5,034,160 | * | 7/1991 | Kindt et al. . | |
| 5,349,793 | | 9/1994 | Bigelow, Jr. . | |
| 5,425,207 | * | 6/1995 | Shayman . | |
| 5,491,934 | | 2/1996 | Bieglow et al. . | |
| 5,634,315 | | 6/1997 | Toya . | |
| 5,642,594 | | 7/1997 | Sucre . | |
| 5,653,459 | | 8/1997 | Murphy . | |
| 5,660,005 | | 8/1997 | Tacoma . | |
| 5,661,937 | * | 9/1997 | Doppler et al. . | |
| 5,778,613 | | 7/1998 | Thomson . | |
| 5,864,992 | * | 2/1999 | Bigelow . | |
| 5,890,327 | * | 4/1999 | Merser et al. . | |
| 5,974,751 | * | 11/1999 | De Zen | 52/439 |

OTHER PUBLICATIONS

As the Needs of he World Change So Does PortaKamp, Porta–Kamp Construction, Inc. 1996.
Porta–Kamp Commercial Mobile/Modular, Porta–Kamp Manufacturing Co., Inc., 1986.
The Worldwide Solution For Temporary and Permanent Housing, Porta–Kamp Construction, Inc., 1996.
Burtin Polyurethane–Line X, Burtin Corp., 1996.

* cited by examiner

*Primary Examiner*—Beth A. Stephan
*Assistant Examiner*—Dennis L. Dorsey
(74) *Attorney, Agent, or Firm*—Guy McClung

(57) ABSTRACT

The present invention, in certain aspects, includes a portable building structure with a bottom section, a top section on the bottom section, the bottom section having at least one bottom support for supporting the top section, the at least one bottom support having a top opening, and the top section having at least one top support with a lower member projecting down into the top opening of the at least one bottom support. The present invention also provides a new bottom section for a building structure, the bottom section having a plurality of support pillars interconnected by interconnection members, each support pillar of the plurality of support pillars having an enlarged top opening for receiving a lower member of an upper section to be emplaced on the bottom section.

8 Claims, 7 Drawing Sheets

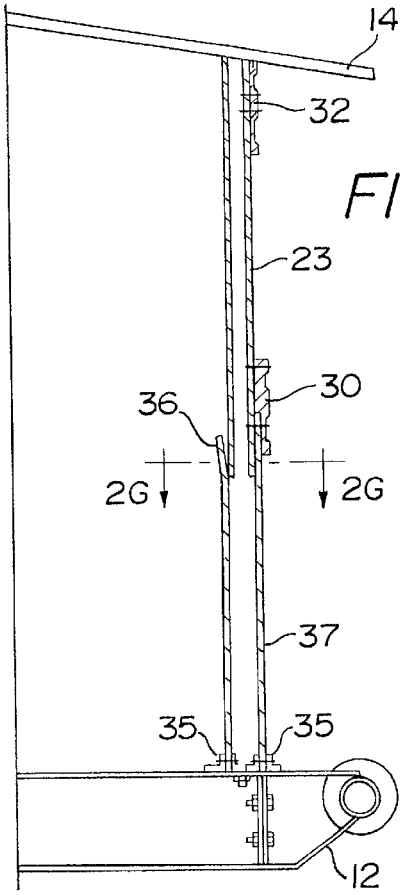
FIG. 2F
FIG. 2G
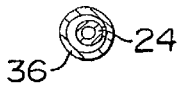
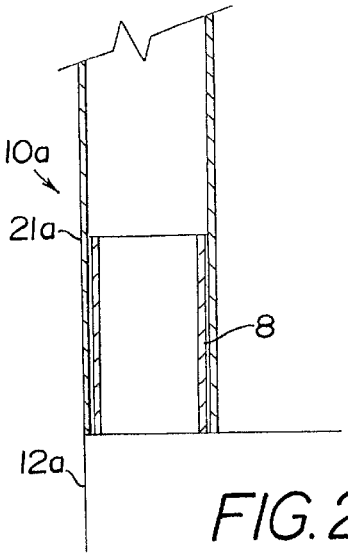
FIG. 2H
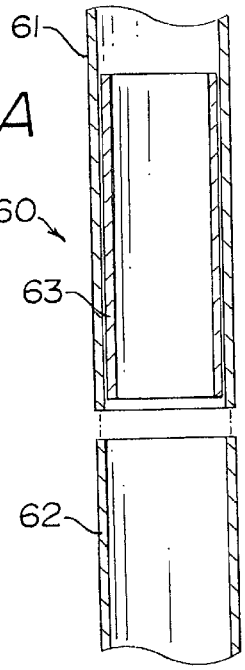
FIG. 3A
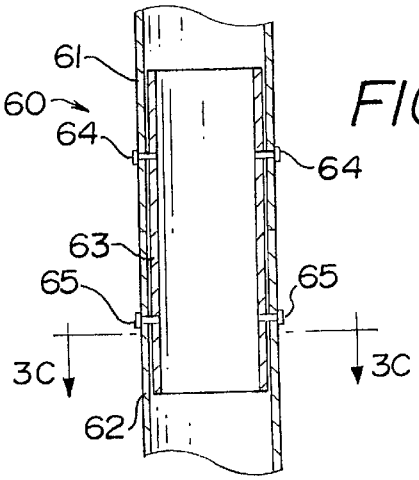
FIG. 3B
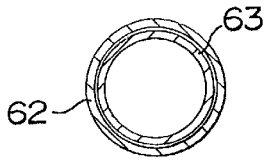
FIG. 3C 150
154
157
153
159
151
152
156
157
153
151

145

146
140
146

144
144
142

142
146
148
140
148
149
145
144

122a
122b
142
122b
122a

BUILDING CONSTRUCTION

BACKGROUND OF THE INVENTION

1. Field of the Invention

This invention is directed to building construction, modular buildings, portable buildings, a building module, and apparatus and methods for facilitating the correct alignment, connection, and stabilization of one building structure on another.

2. Description of Related Art

The prior art discloses a variety of structures and methods for mounting an upper structure (another building, additional story of a building, roof structure, upper deck, etc.) on a lower or base structure. In one prior art system a second story module is emplaced on a first story module and corner beams or braces and/or intermediate members are secured to each story.

As shown in FIG. 1A a prior art system as disclosed in U.S. Pat. No. 4,470,227 discloses structure and methods for stacking one building core on another which are interconnected and secured together with metal angle members at their corners. The angle members serve as guides and supports and hold the cores in stacked condition during shipping.

U.S. Pat. No. 4,364,206 discloses a prior art system with stackable prefabricated building units having vertical corner casings extending into corner openings of a top wall. Bolts through an angle member and the top wall join the vertical casings to the top wall. Bolts through an adjacent unit and support beams join the adjacent unit to the top wall of a lower unit. In another aspect pieces of adjacent units are welded together. In another aspect attached sheet metal panels join together a series of units.

FIG. 1B shows a prior art two-story building on a skid with a floor and upper and lower walls which are interconnected by connection members through which extend bolts or screws into each wall. A ceiling/second story floor is supported by the lower wall. The upper wall's interior side rests on the ceiling/second story floor.

Another common prior art system is the well known use of standard ISO containers and the stacking of such containers one on top of the other. Certain of these prior art systems have a relatively large footprint in use and in transport.

SUMMARY OF THE PRESENT INVENTION

The present invention, in certain embodiments, discloses a multi-story building or a building with a lower structure and an upper structure wherein the first floor or lower structure has at least one wall (or upright support, pillar, pole, or beam) with at least an upper enlarged portion which is sized to receive and hold a lower portion of an upper wall (or upper beam, pillar, pole support). In one aspect the entire length of the wall of the first floor or lower structure is enlarged and the upper wall's or upper support's lower portion is bolted to and within the lower wall and/or rests on one or more steps in the lower wall.

As desired, the upper and lower walls may be further secured together with interconnecting members, ribs, panels, braces, beams, etc. The upper wall may be a wall of an upper story or a support for an upper structure such as a truss or roof. Each lower wall may have an enlarged portion along its entire length; e.g. in a square or rectangular building all four lower walls may have the upper enlarged portion and all upper walls along their entire length may fit into the enlarged portions of the lower walls.

In another aspect, the lower structure initially includes no walls, but has at least one pillar (beam, support, pole, etc.) with an enlarged open upper end which receives and holds a smaller end of an upper pillar (beam, support, pole, etc.). In one aspect the lower structure includes four such lower pillars each with an enlarged or "funnel" upper opening for facilitating the reception into the lower pillars of a lower end of each of four upper pillars. Of course, any suitable number of structures, building units, pillars, etc. may be stacked and interconnected one on top of the other.

In one aspect the lower wall or lower pillar has a top funnel or enlarged portion which is sized so that the lower end of an upper wall or upper pillar fits in it and is held therein by a friction fit, with or without the use of a stop member or members in the lower wall or pillar on which rests the lower end of the upper wall or upper pillar. Any suitable stop member or members may be used; e.g. a bolt or bolts extending into the lower structure; a plate, strip, or strips secured across the interior of the lower structure; an amount of material glued to the interior of the lower structure; a plug, hollow or solid secured in the lower structure; or a cylindrical or semi-cylindrical member secured in a cylindrical pillar. Bolts, screws, glue, or other fasteners may be used through any upper and lower structure or members herein at an area of their overlap to secure them together.

In one aspect the present invention discloses a structure as described above with a lower pillar having at least a top portion which is hollow (and which in one embodiment may be hollow along its entire length) and an upper pillar similarly hollow. A connection member (solid or hollow) that fits within both pillars is disposed with a portion in both pillars and secured to both pillars, e.g. with glue, screws and or bolts. If the pillars are cylindrical, the connection member may be cylindrical, semi-cylindrical, or some portion of a cylinder. Such a connection member facilitates correcting positioning of an upper pillar with respect to a lower pillar. In one aspect the connection member is emplaced within the upper pillar; the upper pillar is moved over the lower pillar; and the connection member is lowered so that part of it extends into the lower pillar. Alternatively the connection member is originally disposed in the lower pillar and it is raised partially so its upper end extends into the upper pillar. In one aspect one or more stops are positioned in the lower pillar to support and position the connection member. In another aspect one or more spring-loaded detents initially holds the connection member in one of the pillars and then holds it in the other. In one aspect two spaced apart detents are used, one holding the connection member to a lower pillar and one holding it to an upper member.

In one embodiment, the present invention discloses a lower pillar with an upper funnel portion which is sized, configured and positioned for receiving a tapered lower nose of a connection member (solid or hollow) originally movably disposed in an upper pillar. The nose may be held in the funnel portion with a friction fit, glue, screws, and/or bolts. The funnel portion may be formed integrally of the lower pillar or it may be a separate piece or pieces disposed on and/or in the upper part of the lower pillar. The funnel portion may be made of the same material as the lower pillar (metal, wood, plastic, fiberglass) or of different material. In one aspect the funnel portion may have an upper lip or upper portion that serves as a shock absorber and/or seal or gasket between an upper and a lower pillar.

Any building unit or structure disclosed herein may be mounted on a skid, frame, truck, or trailer.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious devices and methods for building units, interconnected supports including walls and pillars, methods to facilitate emplacement and positioning of an upper unit or pillar on a lower unit or pillar, and pillars (orwalls) with upper enlarged portions to facilitate reception therein of an upper member.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 2F is a partial cross-section end view of a system according to the present invention usable in the building of FIG. 2A or other buildings. FIG. 2G is a bottom cross section view along line 2G—2G of FIG. 2F. FIG. 2H is a partial side cross-section view of a building and skid mount according to the present invention.

FIGS. 3A and 3B are front cross-section views of component connection systems according to the present invention. FIG. 3C is a cross-section view along line 3C—3C of FIG. 3B.

DESCRIPTION OF EMBODIMENTS PREFERRED AT THE TIME OF FILING FOR THIS PATENT

Figure 1A:
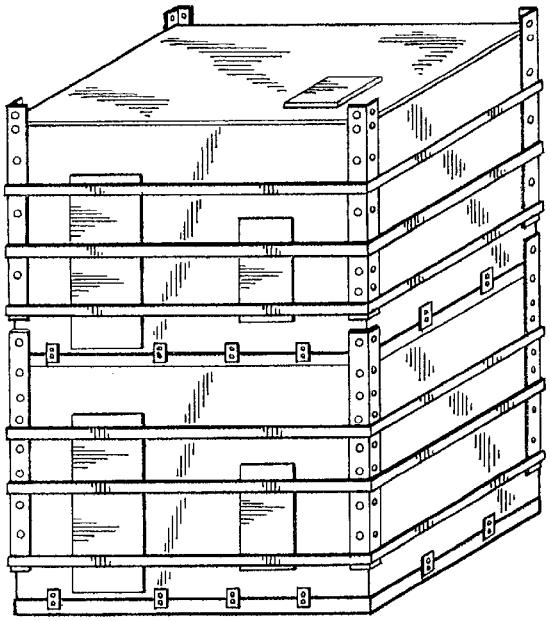
FIG. 1A (PRIOR ART)
FIGS. 1A and 1B show prior art systems.
Figure 1B:
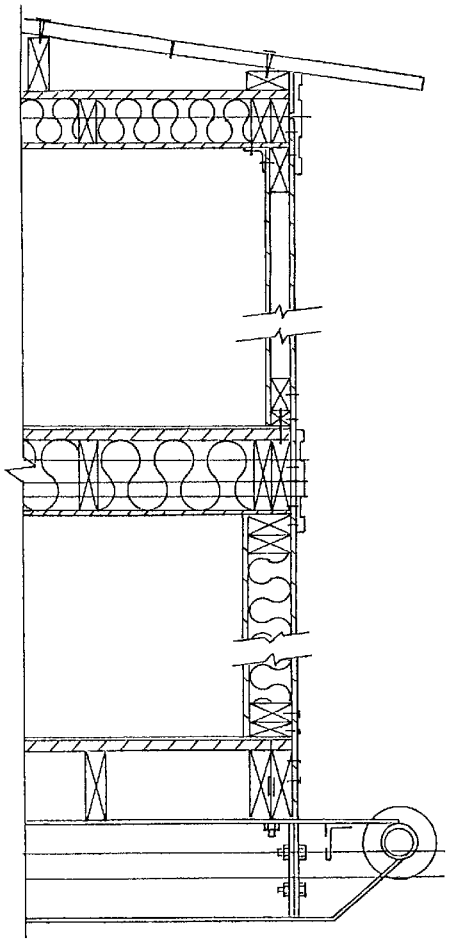
FIG. 1B (PRIOR ART)
Figure 2A:
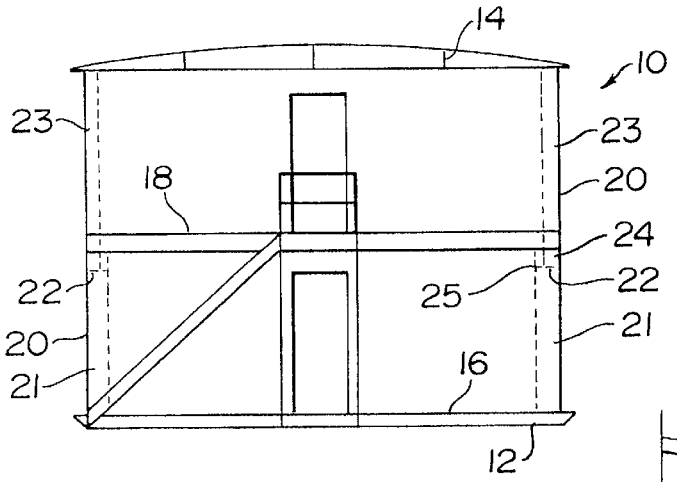
FIG. 2A is an end view of a multi-story building according to the present invention.
Figure 2C:
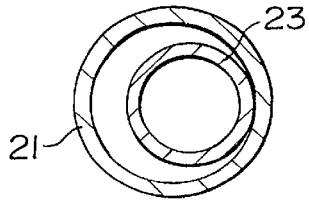
FIG. 2C is a cross-section view along line 2C—2C of FIG. 2B.
Figure 2D:
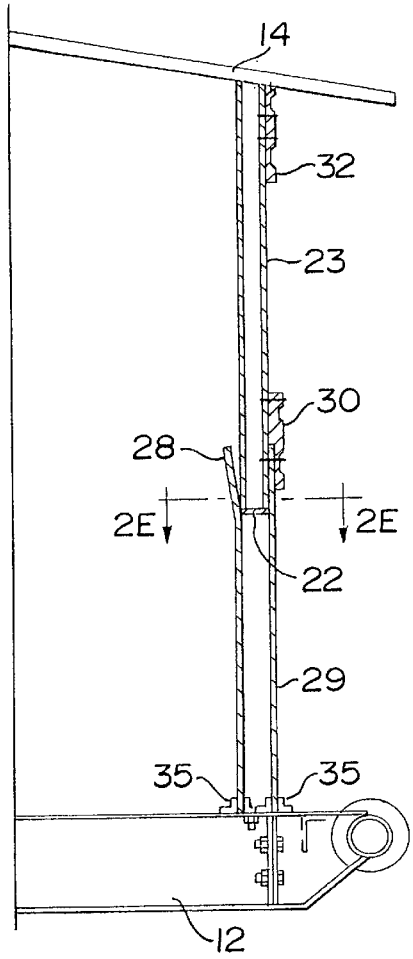
FIG. 2D is a cross-section view along line 2C—2C of FIG. 2C.
Figure 2B:
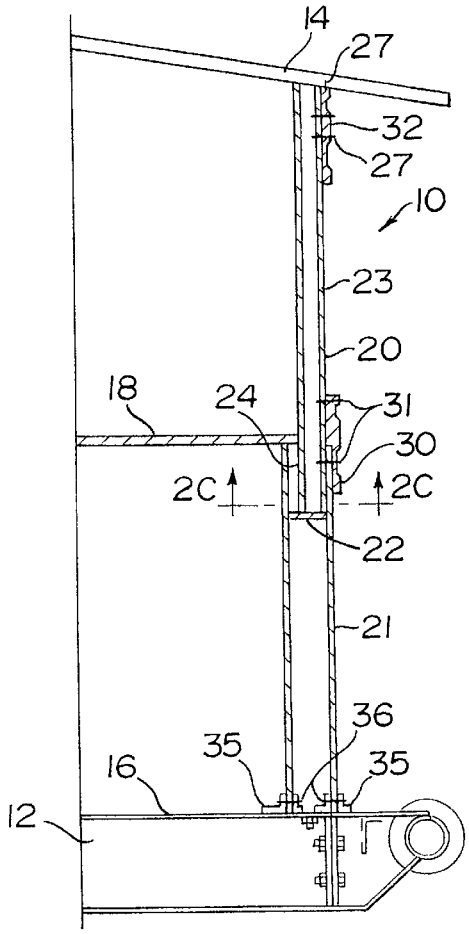
FIG. 2B is a partial cross-section view of the building of FIG. 2A.

FIGS. 2A–2C shows an end of a rectangular building 10 (with an opposite end, not shown; the ends spaced apart by two opposed sides, not shown—e.g. but not limited to a building as in FIG. 2, U.S. Pat. No. 5,491,934) on a skid 12, the building 10 having four pillar supports 20, one in each corner of the building. The building 10 has a truss roof 14, a lower floor 16 (which may be a floor of the skid 12) and an intermediate floor 18.

Each pillar support 20 has a lower pillar 21 with a stop member 22 secured therein and an upper pillar 23 with a lower end 24 within an upper end 25 of the lower pillar 21. The upper pillar 23 rests on the stop member 22. A brace 30 spans the upper and lower pillars and connectors 31 (fasteners, bolts, screws, dowels, etc.) extend through the brace 30 into the pillars. A brace 32 is connected to a top end of the upper pillar 23 and to the roof 14 by connectors 27. The floor 18 rests on the lower pillar 21 and abuts the upper pillar 23. Mounting brackets 35 with bolts 36 extending through the lower pillar 21 mount it to the skid 12. A plurality of two, three, four or more braces 30 and/or 32 may be used with the building of FIG. 2F or with any building or structure disclosed hereon. FIG. 2H shows an alternative skid mounting structure according to the present invention in which a hollow pillar 21*a* of a building 10*a* (like the building 10) is positioned around a hollow member 8 secured to a skid 12*a*. One or more optional removable pins or bolts 7 may be used to secure the pillar 21*a* to the hollow member 8. This same structure may be used to mount any building disclosed herein on a floor or foundation.

Figure 2E:
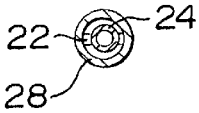
FIG. 2E is a bottom cross-section view along line 2E—2E of FIG. 2D.

FIGS. 2D–2E show a pillar system 40 according to the present invention with some parts like those of the system of FIG. 2A; and like numerals indicate the same parts. In the system 40 a lower pillar 21 has an upper enlarged portion 28 which receives the lower end 24 of the upper pillar 23.

FIGS. 2F–2G show a pillar system 50 according to the present invention which is like the system of FIG. 2D but which uses a friction fit of the lower end 24 of the upper pillar 23 in an enlarged portion 36 of a lower pillar 37 rather than a stop member. Of course it is within the scope of this invention to use both such a friction fit and stop member.

FIGS. 3A–3C show a pillar connection system 60 for connecting an upper pillar 61 and a lower pillar 62 which are used as the pillars in the systems described above. A connection member 63, in this case in the form of a hollow cylindrical sleeve, may initially reside in either pillar or it may be emplaced therein prior to use. As shown in FIG. 3B, the connection member 63 has an upper end within the upper pillar 61 and a lower end within the lower pillar 62. Bolts 64 releasably secure the connection member to the upper pillar 61 and bolts 65 releasably secure the connection member 63 to the lower pillar 62.

Figure 4A:
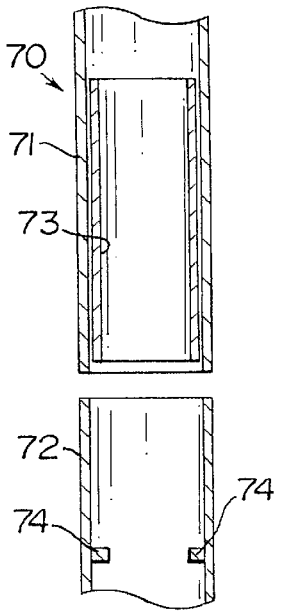
FIGS. 4A and 4B are front cross-section views of component connection systems according to the present invention.
Figure 4B:
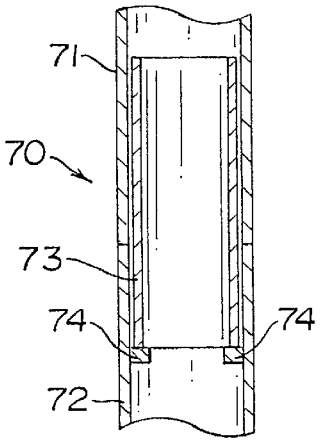

FIGS. 4A and 4B show a pillar system 70 according to the present invention (usable with any building or structure disclosed herein) with an upper pillar 71 and a lower pillar 72 which are hollow cylinders as are the pillars in FIG. 3A (but which may be, as may be any pillar herein, any desired shape as viewed from above, including, but not limited to, oval, square, rectangular, triangular, or polygonal). A connecting sleeve 73 (like the connecting member 63) is initially disposed either in a lower end of the upper pillar 71 (as shown in FIG. 4A) or in an upper end of the lower pillar 72 (not shown). Upon assembly, the connecting sleeve 73 has a lower end that rests on stop members 74 secured to or formed integrally of the lower pillar 72. Alternatively, the connecting sleeve 73 may initially be placed and/or secured in either pillar in the position shown in FIG. 4B, e.g. with glue, screws, bolts, or other fasteners or connectors.

Figure 5A:
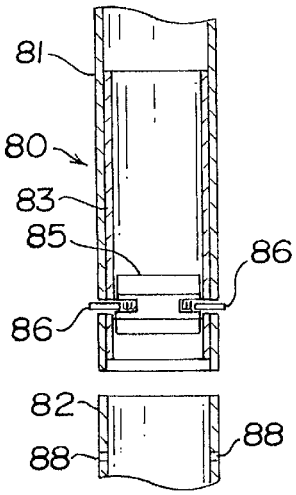
FIGS. 5A, 5B and 5C are front cross-section views of component connection systems according to the present invention.
Figure 5B:
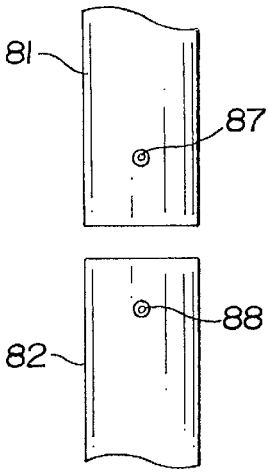
Figure 5C:
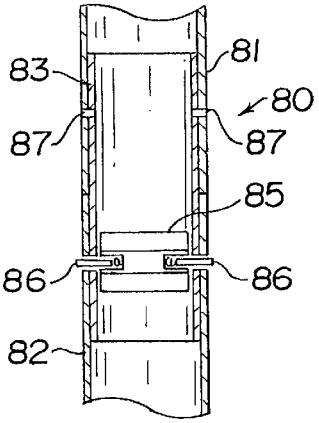

FIGS. 5A–5C show a pillar system 80 according to the present invention (usable with any building or structure herein) with an upper pillar 81 and a lower pillar 82 which are hollow cylinders like the pillars in FIG. 3A. A connecting sleeve 83 (shaped like the connecting member 63) is initially held up in the upper pillar 81 by a detent mechanism 85 having one, two, three, or more (at least one) spring-loaded detents 86 which initially and releasably project through holes 87 in the connecting sleeve 83 and holes 88 in the upper pillar 82.

Figure 6A:
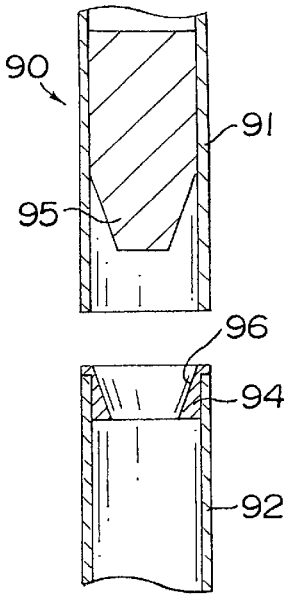
FIGS. 6A and 6B are front cross-section views of component connection systems according to the present invention.
Figure 6B:
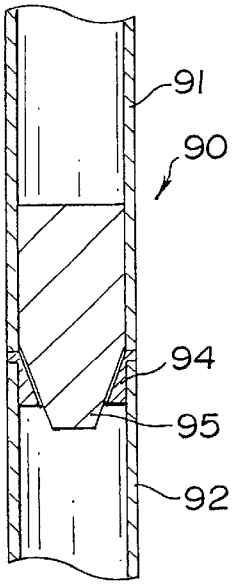

FIGS. 6A and 6B show a pillar system 90 according to the present invention with an upper pillar 91 and a lower pillar 92 (in one aspect, hollow cylinders like previously described pillars). A connecting member 93 is initially movably disposed in the upper pillar 91. The lower pillar 92 has a funnel member 94 emplaced on and/or secured to an upper end of the lower pillar 92. A tapered nose 95 of the connecting member 93 is sized and configured for reception in a tapered funnel portion 96 of the funnel member 94. Screws, bolts, glue or other fasteners or connectors may be used to secure the nose 95 to the lower pillar 92 and/or to the funnel member 94.

Figure 7A:
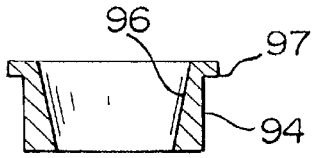
FIG. 7A is a side view in cross-section of the funnel portion of the lower pillar of the connection system of FIG. 6A.
Figure 7B:
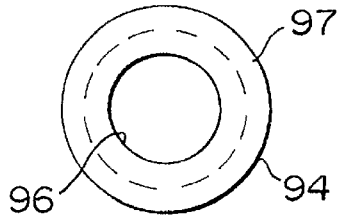
FIG. 7B is a top view of the funnel portion of FIG. 7A.

FIGS. 7A and 7B show a funnel member 94 with a lip 97. The lip or the entire funnel member may be made of shock absorbing material foam, plastic, seal material, metal, fiberglass composite, gasket material, or wood.

Figure 8A:
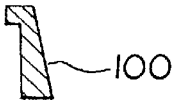
FIG. 8A is a side view in cross-section of a funnel member according to the present invention.
Figure 8B:
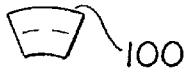
FIG. 8B is a top view of the funnel member of FIG. 8A.

FIGS. 8A and 8B show a funnel member 100 which is, in effect, a portion of the funnel member 94. One or more such funnel members 100 are used within a pillar to guide and hold a nose like the nose 95 or (as may be the case with the funnel member 94) to guide and hold a connecting member or sleeve which is small enough to enter between the funnel members (or into the full funnel).

Figure 9A:
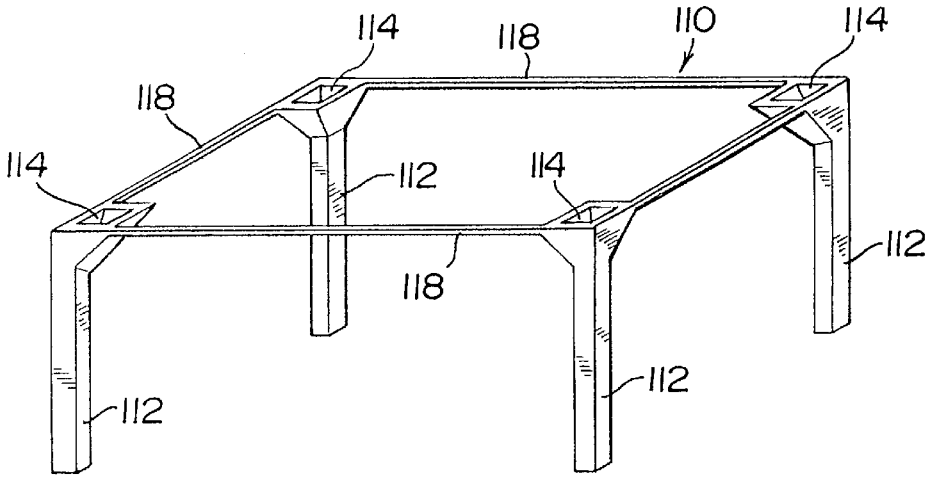
FIG. 9A is a perspective view of a multi-pillar building structure according to the present invention.
Figure 9B:
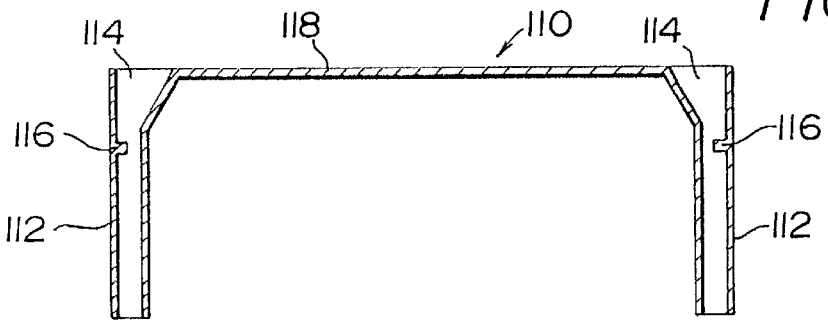
FIG. 9B is an end view in cross-section of the structure of FIG. 9A.

FIGS. 9A and 9B show a building structure 110 according to the present invention with four pillars 112, each having an enlarged top opening 114 for facilitating receiving a pillar or other member of a building module, structure, deck, unit, etc. from above. An optional stop member 116 may be used on each pillar 112. Connecting members 118 interconnect the four pillars. In any such structure with four pillars only one, two, or three such pillars with enlarged top openings may be used and/or a pair of opposed pillars with enlarged top openings. Also, a structure with any number of pillars may have one or more pillars like those in FIG. 9A.

Figure 10A:
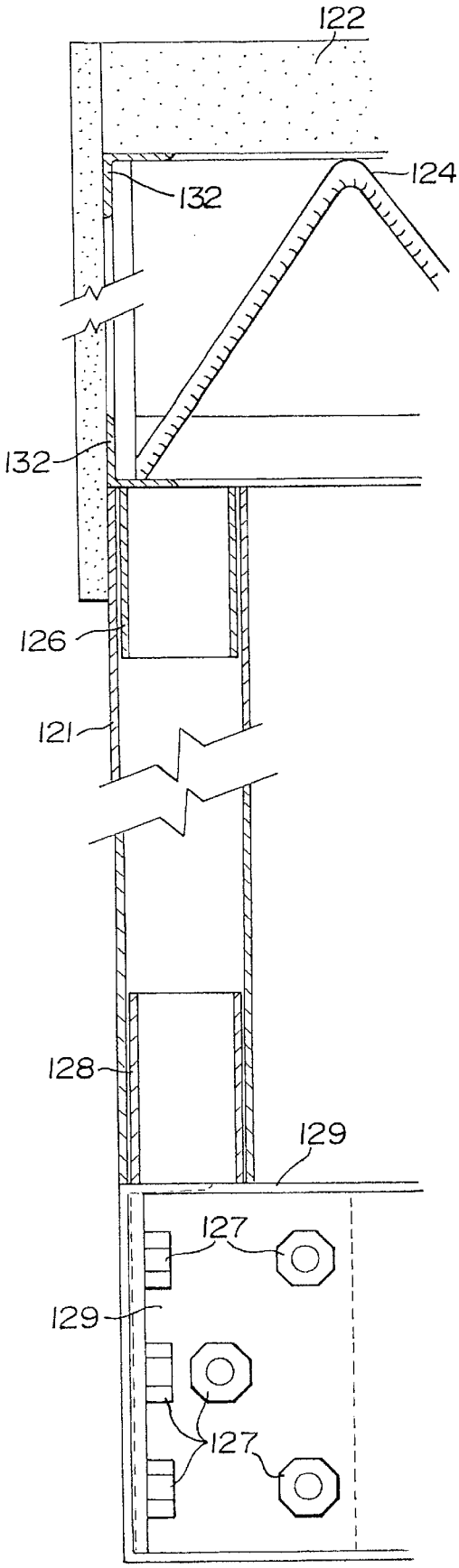
FIG. 10A is a side cross-section view of a building according to the present invention.
Figure 10B:
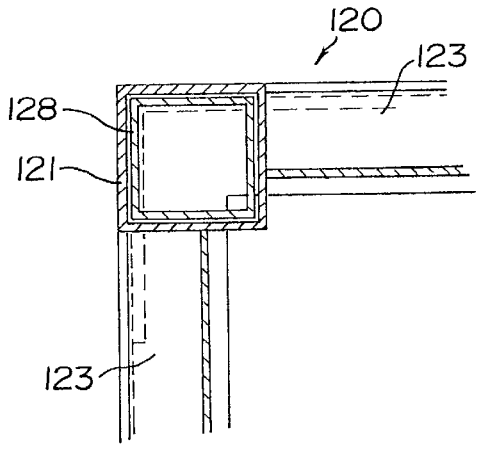
FIG. 10B is a top cross-section view of part of the building of FIG. 10A.
Figure 10C:
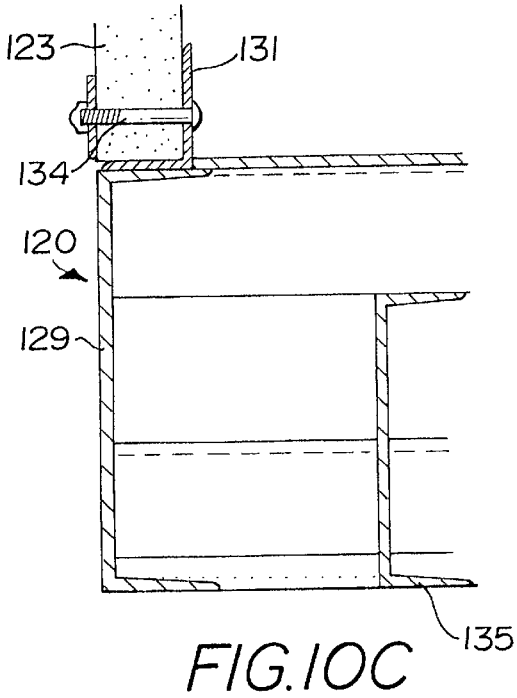
FIG. 10C is a side cross-section view of part of the building of FIG. 10A.

FIGS. 10A–10C show a building 120 (like the building 10 and with certain parts not shown as with the building 10) with a roof covering 122 made of any suitable material, including, but not limited to, spray-on plastic or roof membrane material. The roof covering 122 covers a roof truss 124 and a portion of the roof covering 122 projects down past the truss 124 and is adjacent an exterior surface of a pillar 121. In one aspect there are four pillars 121 with walls 123 between them (e.g., any wall disclosed herein) and, optionally, the roof covering projects down around the four walls 123.

L-shaped protectors 132 cover the edges of the truss 124 and completely surround it. A sub-pillar 126 secured to the truss 124 projects down into and is held within a hollow portion of the pillar 121. A sub-pillar 128 is secured to a floor, foundation, or frame 129 and projects upwardly into and is held within the hollow pillar 121. Bolts 127 bolt together frame pieces. Such a pillar/sub-pillar mounting structure may be used with any building disclosed herein. Walls 123 are secured to mounting members 131 with bolts 134. The members 131 are secured to the frame 129, e.g., welded and/or bolted thereto. Support members 135 (one shown) are secured in theframe 129 and facilitate lifting and movement of the structure by mechanical equipment, e.g., but not limited to, by a forklift.

FIGS. 11A–11D show a covered roof truss 140 (like the truss 124 and roof covering 122, FIG. 10A) with covering 145 on a truss 140 mounted on a skid 142. The skid 142 (or floor or foundation) has hollow upwardly projecting members 144 that receive and hold downwardly projecting member 146 of the covered roof truss 140. The roof covering, which is optional, is sized to abut an upper surface 148 of the skid 142 to seal the truss/skid interface. Parts of a building 148 (including but not limited to one or more walls) and/or other items may be stored in a space 149 between the truss 140 and the skid 142. The members 144, 146 may be any desired shape and/or cross-section, including, but not limited to, tubular, triangular, square, rectangular, pentagonal or hexagonal. The members 146 may be solid or hollow. Conversely the members 146 may be hollow and be sized to receive the members 144.

Figures 11A, 11B, 11C, 11D, 11E, 12:
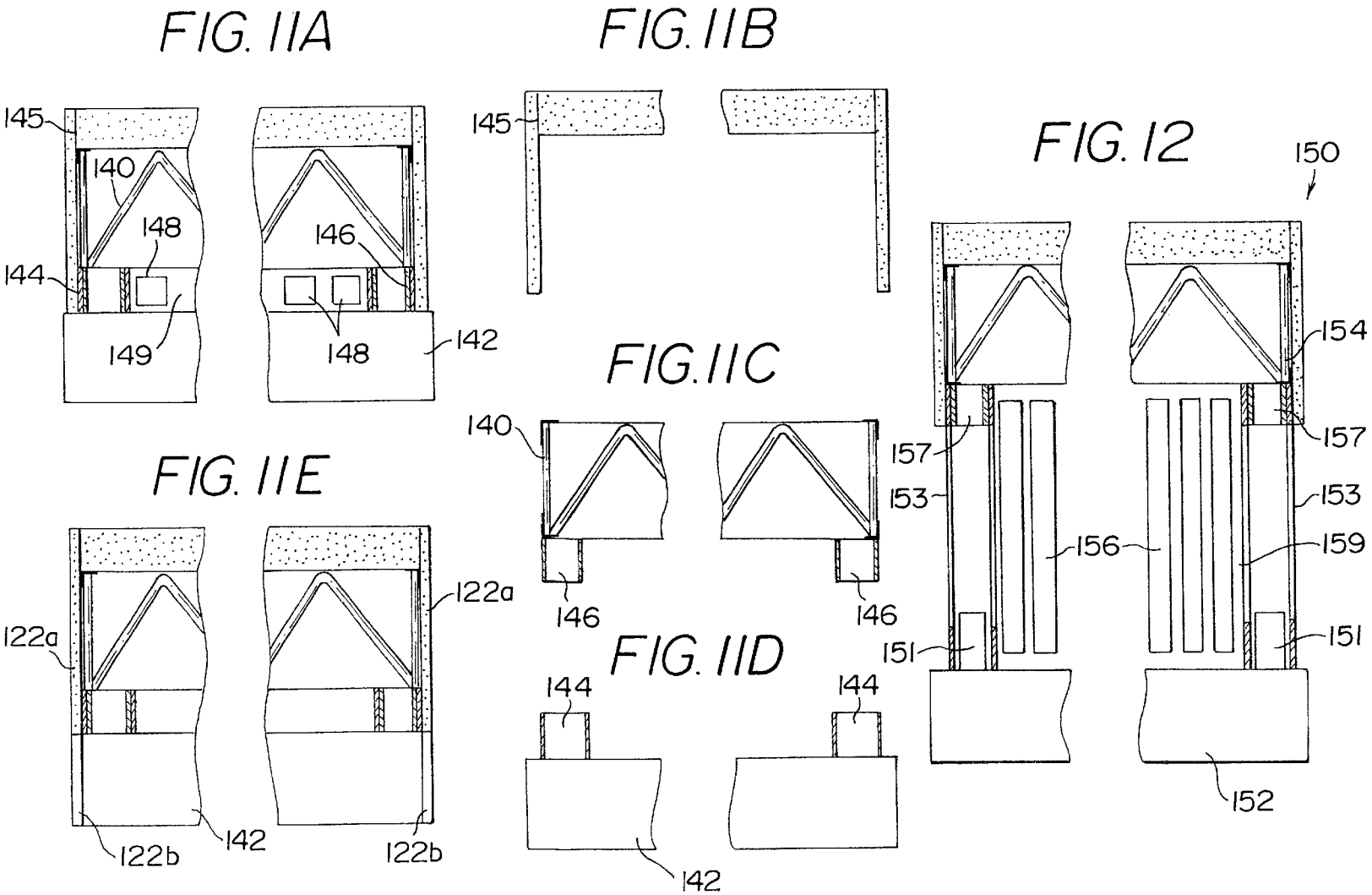
FIG. 11A is a side cross-section view of a roof truss and skid according to the present invention.
FIGS. 11B–11D show parts of the structure of FIG. 11A.
FIG. 11E presents an alternative embodiment of the structure of FIG. 11A.
FIG. 12 is a side cross-section view of a roof truss and skid according to the present invention.

FIG. 11E presents an alternative roof covering **122*a* for the structure 140. Lower ends 122*b* of the roof covering 122*a* encompass the skid 142** and seal against it.

FIG. 12 shows a structure 150 like that of FIG. 11A, but with an enlarged space 159 between a roof truss 154 and a skid 152. The space 159 may be sized to hold some or all of the structural components and members 156 of a building (including, but not limited to walls of the building) to be assembled with the roof truss 154. The skid 152 may be, alternatively, a floor or foundation; or a skid itself may serve as a floor. Members 157 (like the members 146, FIG. 11C) project down into a hollow tubular 153 (the structure including one, two, three, four or more tubulars 153) and members 151 secured to the skid 152 project up into the tubulars 153.

Any building and/or truss/skid combination disclosed herein may be sized to be liftable by a crane or appropriate lifting device, and to have a minimal foot print when packaged on a skid for transport.

The present invention, therefore, provides in certain if not all embodiments a portable building structure with a bottom section, a top section on the bottom section, the bottom section having at least one bottom support for supporting the top section, the at least one bottom support having a top opening, and the top section having at least one top support with a lower member projecting down into the top opening of the at least one bottom support. Such a building structure may have one, some (in any combination) or all of the following: wherein the at least one bottom support is a plurality of bottom supports that support the top section; a roof over the top section and secured thereto; a skid, the bottom section mounted on the skid; the skid with at least one upwardly projecting hollow skid support with a top opening, the bottom section has at least one downwardly projecting bottom member projecting into and held in the top opening of the at least one hollow skid member; wherein the at least one upwardly projecting hollow skid support is a plurality of hollow skid supports and the at least one downwardly projecting bottom member is a plurality of bottom members, one bottom member corresponding to each of the plurality of upwardly projecting hollow skid supports; at least one cross member extending within and from one interior side of the bottom section, the lower member of the at least one top support contacting the at least one cross-member; wherein the bottom section has an interior and the at least one cross member extends completely across the interior of the bottom section; wherein the at least one cross-member is a plurality of stop members; wherein the top opening of the bottom support has a funnel-shaped portion; at least one brace connected to both the top section and the bottom section; at least one brace connected to the roof and to the top section; the top section including a roof truss; a roof covering on the roof truss; and/or a floor extending across a lower portion of the top section.

The present invention, therefore, provides in certain if not all embodiments, a portable building structure with a bottom section, a top section on the bottom section, the bottom section having at least one bottom support for supporting the top section, the at least one bottom support having a top opening, and the top section having at least one top support with a lower member projecting down into the top opening of the at least one bottom support, wherein the at least one bottom support is a plurality of bottom supports that support the top section, a roof over the top section and secured thereto, a skid, the bottom section mounted on the skid, the skid has at least one upwardly projecting hollow skid support with a top opening, the bottom section has at least one downwardly projecting bottom member projecting into and held in the top opening of the at least one hollow skid member, wherein the at least one upwardly projecting hollow skid support is a plurality of hollow skid supports and the at least one downwardly projecting bottom member is a plurality of bottom members, one bottom member corresponding to each of the plurality of upwardly projecting hollow skid supports,the top section including a roof truss, a roof covering on the roof truss, and a floor extending across a lower portion of the top section.

The present invention, therefore, provides in certain if not all embodiments, a bottom section for a building structure, the bottom section having a plurality of support pillars interconnected by interconnection members, each support pillar of the plurality of support pillars having an enlarged top opening for receiving a lower member of an upper section to be emplaced on the bottom section.

The present invention, therefore, provides in certain if not all embodiments,a portable building structure with a bottom section, a top section on the bottom section, the bottom section having at least one bottom support for supporting the top section, the at least one bottom support having a top opening, the top section having at least one top support with a lower member projecting down into the top opening of the at least one bottom support, and a sub-pillar with a portion within the at least one bottom support and a portion within the at least one top support. Such a structure may have one, some (in any possible combination) or all of the following: at least one bolt securing the sub-pillar to at least one of the at least one bottom supports and at least one top support; at least one cross member extending within and from one interior side of the bottom section, the lower member of the at least one top support contacting the at least one cross-member; at least one releasable detent mechanism on the sub-pillar with a detent releasably extending through a hole in the at least one bottom support; a funnel member in the bottom section, the subpillar having a lower tapered end for receipt within the funnel member; a roof over the top section and secured thereto, a skid, the bottom section mounted on the skid, the top section including a roof truss, a roof covering on the roof truss, and a floor extending across a lower portion of the top section; and/or the skid has at least one upwardly projecting hollow skid support with a top opening, and the bottom section has at least one downwardly projecting bottom member projecting into and held in the top opening of the at least one hollow skid member.

The present invention, therefore, provides in certain if not all embodiments, a portable building structure with a roof truss with at least one roof truss support projecting downwardly therefrom, a skid with at least one skid support projecting upwardly therefrom, the roof truss on the skid, and a portion of one of the supports received within the other support. Such a structure may have one, some (in any possible combination) or all of the following: a roof covering on the roof truss, a lower portion of the roof covering sealingly contacting the skid; wherein the lower portion of the roof covering extends downwardly encompassing the skid; wherein the roof truss and the skid define a storage space therebetween; building components within the storage space for making a building with the roof truss; and/or wherein the building components include walls for the building.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A portable building component system, the components present as separate unassembled parts of a portable building, the system comprising a roof truss having a top and sides, a skid with a top surface, the roof truss on the skid, a roof covering on the roof truss, the roof covering made of roof covering material, the roof truss enclosed within the covering, the roof covering having a top portion above the roof truss and side portions extending down from the top portion on the sides of the roof truss, the side portions made of roof covering material, and the roof coverings side portions having a lower surface sealingly abutting a portion of the top surface of the skid.

2. The portable building component system of claim 1 wherein the lower portion of the roof covering extends downwardly encompassing the skid.

3. The portable building component system of claim 1 wherein the roof truss and the skid define a storage space therebetween.

4. The portable building component system of claim 3 further comprising building components within the storage space for making a building with the roof truss.

5. The portable building component system of claim 4 wherein the building components include walls for the building.

6. The portable building component system of claim 1 further comprising a plurality of supports for supporting the roof truss, each support having a top opening, and the roof truss having a plurality of downwardly projecting members, each projecting down into a top opening of a corresponding one of the plurality of supports.

7. The portable building component system of claim 1 wherein the skid has at least one upwardly projecting hollow support with a top opening, the roof truss has at least one downwardly projecting bottom member projecting into and held in the top opening of the at least one upwardly projecting hollow support.

8. The portable building component system of claim 7 wherein the at least one upwardly projecting hollow support is a plurality of hollow supports and the at least one downwardly projecting bottom member is a plurality of bottom members, one bottom member corresponding to each of the plurality of upwardly projecting hollow supports.

* * * * *